US006253795B1

(12) United States Patent
Kuster et al.

(10) Patent No.: US 6,253,795 B1
(45) Date of Patent: Jul. 3, 2001

(54) TENSIONING APPARATUS AND METHOD FOR AN INTERLACED THREAD

(76) Inventors: Stephan Kuster, 800 E. Bronx; Heinz Kuster, 1000 Wrencoe Loop Rd., both of Sandpoint, ID (US) 83864

( * ) Notice: Subject to any disclaimer, the term of this patent is extended or adjusted under 35 U.S.C. 154(b) by 0 days.

(21) Appl. No.: 09/266,700

(22) Filed: Mar. 11, 1999

Related U.S. Application Data

(60) Provisional application No. 60/078,016, filed on Mar. 14, 1998.

(51) Int. Cl.[7] ..... D03D 47/34
(52) U.S. Cl. ..... 139/194; 139/450
(58) Field of Search ..... 242/156, 419.7; 139/194, 383 AA, 450

(56) References Cited

U.S. PATENT DOCUMENTS 4,269,131 * 5/1981 Principe ..... 112/273
4,359,068 * 11/1982 Loepfe et al. ..... 139/370.2
4,513,792 4/1985 Lincke .
4,976,292 12/1990 Matsumoto .
5,050,648 * 9/1991 Pezzoli ..... 139/450
5,105,856 4/1992 Wahhoud .
5,462,094 10/1995 Josefsson .
5,476,122 * 12/1995 Schuster et al. ..... 139/194
5,492,153 * 2/1996 Stacher et al. ..... 139/453
5,725,029 3/1998 Loehr .

FOREIGN PATENT DOCUMENTS

04023772A * 5/1990 (JP) .

* cited by examiner

*Primary Examiner*—Andy Falik

(57) ABSTRACT

A tensioner for gripping an inserted thread in a weaving shed and applying or removing tension based on the thread's inserted tension. Through the use of sensors in a thread gripper, the inserted thread tension is compared to a desired value in a controller which controls the direction of rotation of a drive motor connected to the tensioner. A thread positioner which cooperates with the gripper assures that the threads are repeatedly gripped at the same general location. This expedites the detection of the inserted tension and avoids false initial tension readings.

11 Claims, 6 Drawing Sheets

Sequence of Events as Shuttle 5 Travels to the Right Side A of the Weaving Machine.

c.w. = Clockwise
c.c.w. = Counter Clockwise
G/Arm = Gripper Arm
T/Tension = Thread Tension
W/Machine = Weaving Machine

Sequence of Events as Shuttle 5 Travels to the Left Side B of the Weaving Machine is the Same but the Rotation of the Gripper Arm is in the Reverse Direction.

TENSIONING APPARATUS AND METHOD FOR AN INTERLACED THREAD

This appln. claims benefit of provisional appln. 60/078,016, Mar. 14, 1998.

BACKGROUND OF THE INVENTION

1. Field of the Invention

The invention generally relates to holding a desired tension in a length of thread (yarn, wire, etc.) during interlacing with other threads. The invention is more specifically related to the application of different tensions between threads and variable lengths of time for holding the tension.

In particular, it concerns an apparatus for use with an interlacing apparatus, for example, a weaving loom, which is positioned just outside of the fabric selvage to control the tension of an inserted thread as it is stretched across the weaving loom thru an open shed.

2. Prior Art

It has been known that tensioning devices are desirable to control the threads and apply a predetermined tension to the thread during a certain time frame which is related to thread insertion. It is important to insert the thread with a specific tension to avoid slack or tight threads which diminish the product's quality. If the tension is too low, thread loops protrude from the fabric surface, or if the tension is too high, the fabric edges are pulled toward the fabric's center.

U.S. Pat. No. 4,976,292 describes a tensioning device that grips and holds the free end of an inserted thread while applying tension in synchronism with the insertion motion. The synchronized motion is achieved by the free end of the thread being pushed into the holding device during a beat-up motion.

In U.S. Pat. No. 5,105,856, the tensioning device is based on the concept that a thread guide pin, driven up and down in synchronism with the beat-up motion stretches, tensions the thread, either due to the return motion of the beat-up or by an additional component.

In U.S. Pat. No. 4,513,792, the tensioning device has a rod which oscillates at the cadence of the weaving machine transversely of the inserted thread position. The rod deflects the thread to a retaining element that holds it during the rod's upward movement. This device requires elaborate, synchronized control of the tensioner's movement.

In U.S. Pat. Nos. 5,462,094 and 5,725,029, the disclosed devices use brakes to control the thread's tension. Such brakes may control the tension during the process where a thread is paid out in a weaving loom. Such brakes may also be combined with sensors to stop the machine motion if the tension is too low or too high during the thread laying out process. Such brake systems may control different tensions as when multiple threads are inserted.

SUMMARY OF THE INVENTION

The present invention provides a tensioner for gripping an inserted thread and applying or removing tension based on the thread's inserted tension. Through the use of sensors in the gripping means, the as inserted tension is compared to a desired value in a controller which controls the direction of rotation by the drive motor connected to the tensioner. The present invention provides for a thread positioner which cooperates with the gripper to assure that the threads are repeatedly gripped at the same general location. This expedites the detection of the inserted tension and avoids false initial readings.

DESCRIPTION OF PREFERRED EMBODIMENT

Figure 1:
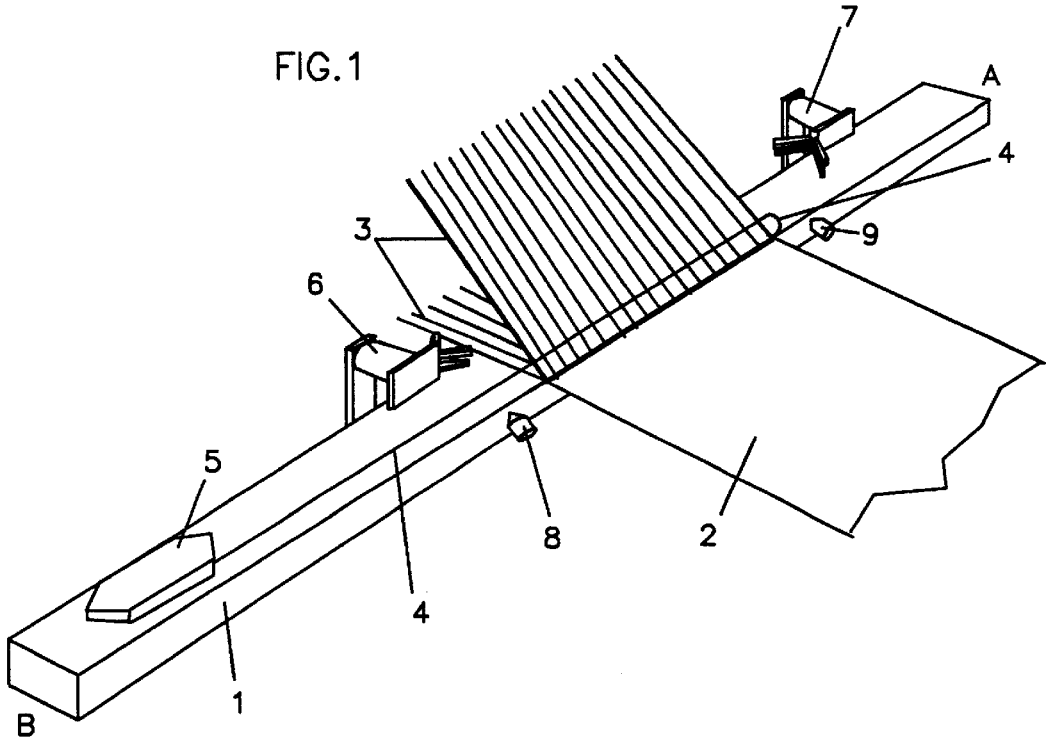
FIG. 1 illustrates the thread tensioner of the invention in a shuttle weaving loom as viewed from the weaver's position.

FIG. 1 shows a section of the slay beam (1) in the thread insertion position. The shuttle 5 is in its end position after having inserted the thread 4. Preferably, a thread tensioning apparatus 6 or 7 is placed on either side of the loom just outside of the fabric edge. Thus, each apparatus 6 or 7 will be programmed to engage a thread traveling to a respective edge of the loom. During thread insertion, the thread tensioner 6 and 7 are in the rest position, illustrated as position R in FIG. 2. As soon as the shuttle 5, traveling in it's given direction, passes sensor 8 or 9, which may be optical sensors, it signals the tensioning apparatus 6 or 7 to start the tensioning process. Since the tensioners operate in the same manner, the remaining description will refer to only tensioner 6. The tensioning apparatus 6 rotates into position X to engage the thread 4 and travels in the direction of the shuttle A to B in FIG. 1, through positions Y and Z until the desired tension is applied to the thread 4. The tensioning apparatus rotates to a stop at position Z and the thread tension is held until the inserted thread is locked by the closing of the shed.

As the loom changes in accordance with the pattern, a sensor signal created by the pattern causes the tensioning apparatus 6 to free the thread from its grip. The tensioner 6 is then free to return to the rest position. The tensioning process is then repeated as the next thread is inserted.

Figure 2:
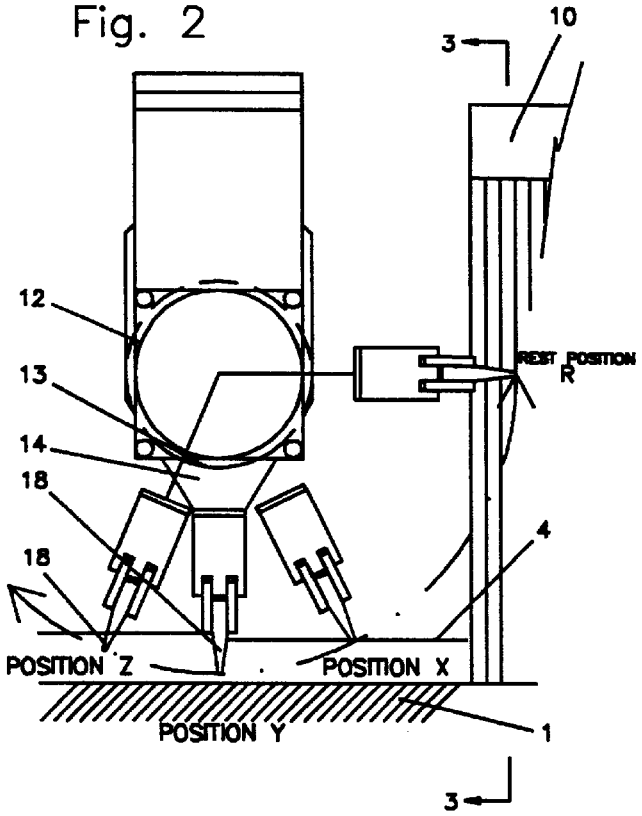
FIG. 2 illustrates the preferred travel path of the present invention as seen from either position A or B of FIG. 1.
Figure 3:
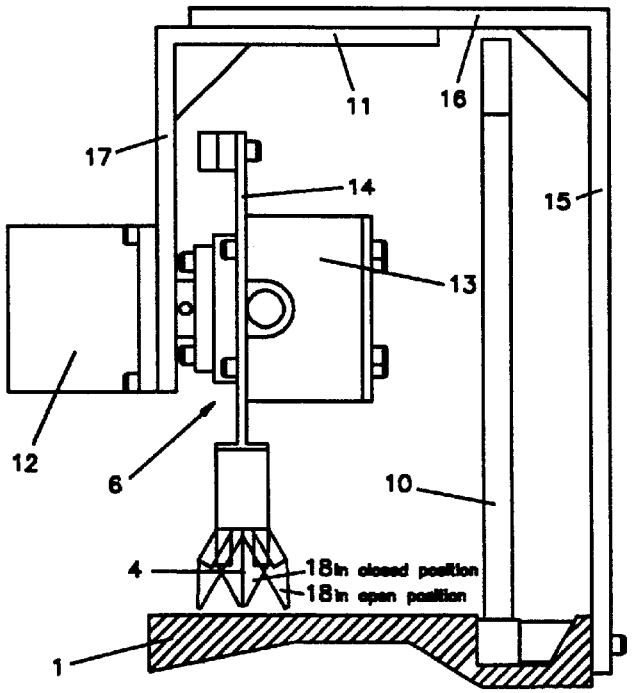
FIG. 3 is a side elevation illustrating the position of the thread tensioner relative to the slay and the reed as seen along the line 3—3 of FIG. 2.

With reference to FIGS. 2 and 3, the position of the invention relative to the loom can be seen. In FIG. 3, a reed 10 is illustrated on the slay beam 1. The thread 4 is illustrated in the closed gripper 18 of tensioner 6 with the thread 4 positioned above the surface of beam 1. The mounting brackets, 11,15,16 and 17 are affixed to the backside of the slay beam 1 so as to hold the tensioning device in the thread's travel path. Tensioner 6 includes a motor 12, such as a stepper or servo motor, a torque sensor 13 connected to the motor's shaft, and tensioner arm 14 mounted on the torque sensor 13 for holding the gripper 18. With the gripper 18 open, the tensioner is in the rest position, to enable the shuttle 5 to pass underneath it. Recognition that a shuttle 5 has passed sensor 8 of FIG. 1, activates the motor 12 and begins rotation of arm 14. When the tensioner passes position X in FIG. 2, a controller signals the gripper 18 to close. As soon as the gripper has closed, the tensioner 6 starts to stretch and tension the thread. The position Y where the gripper is fully closed is generally perpendicular to the thread path of travel. The final tension position Z is where motor rotation stops, because either the servo motor reaches an electric resistance equal to the set resistance corresponding to the desired tension, or the torque sensor responds having reached the torque equal with the tension multiplied by the tension arms distance between the gripper and stepper motor's shaft. In it's final tension position the tensioner holds the tension in the thread until the controller opens the gripper, frees the thread, and rotates the gripper and tension arm back into its rest position R.

Figure 4:
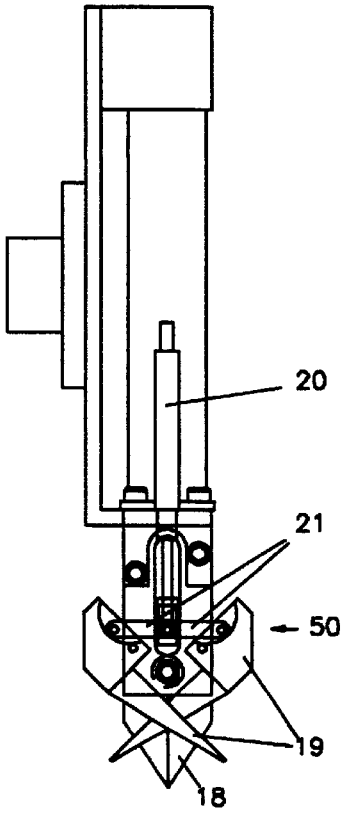
FIG. 4 is a side elevation of a thread positioner according to the invention for locating the thread relative to the thread tensioner.
Figure 5:
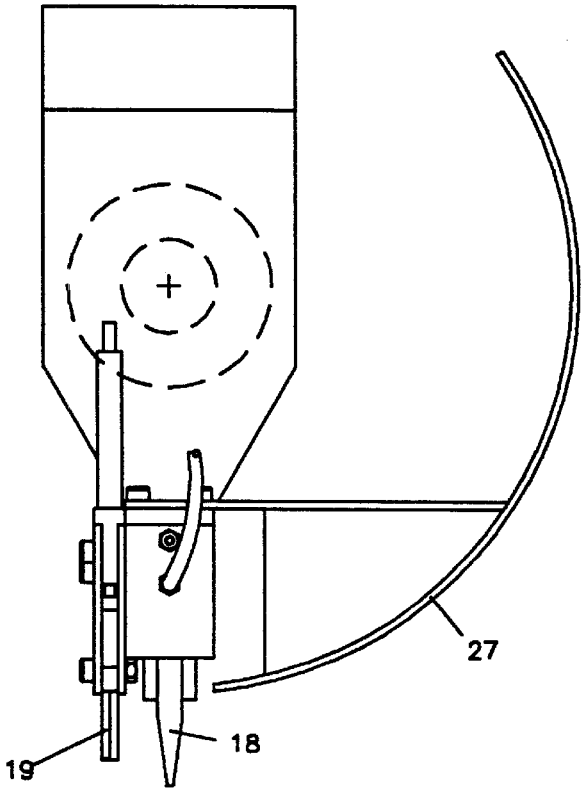
FIG. 5 illustrates the thread positioner and thread tensioner assembled in an apparatus according to the present invention.
Figure 6:
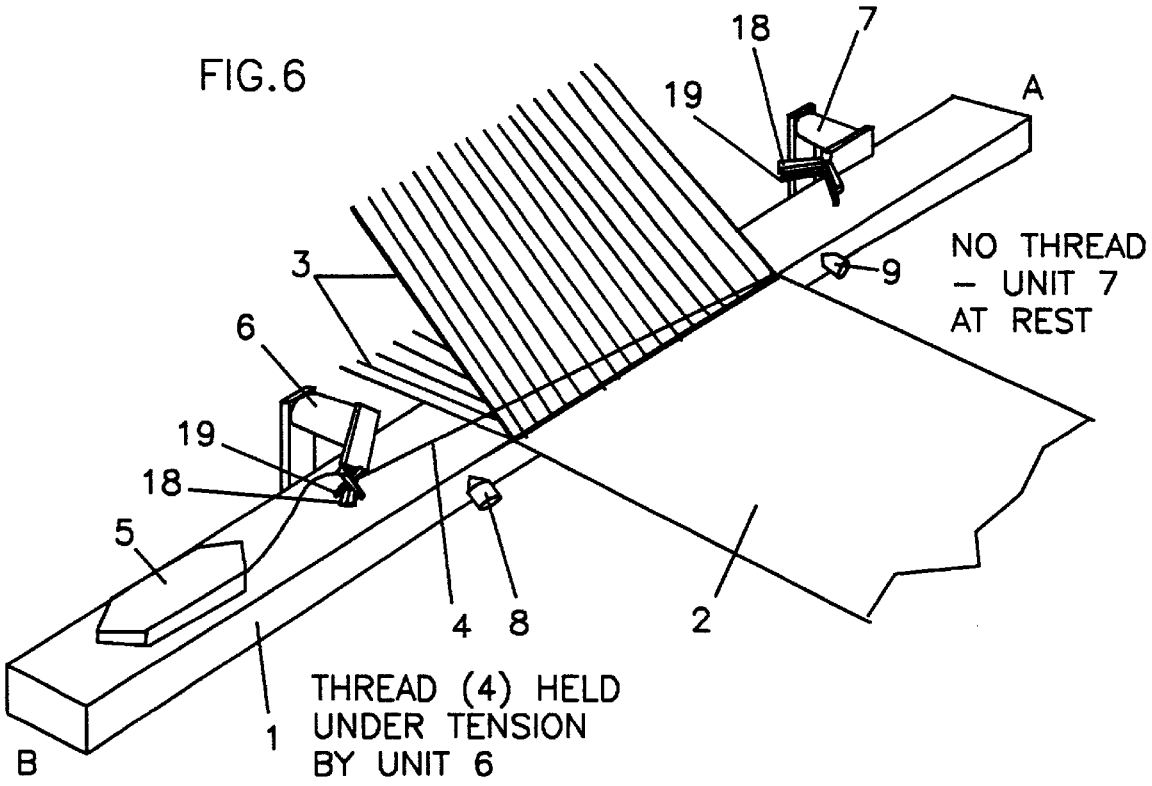
FIG. 6 illustrates the location of the present invention relative to a thread path along the slay.
Figure 7:
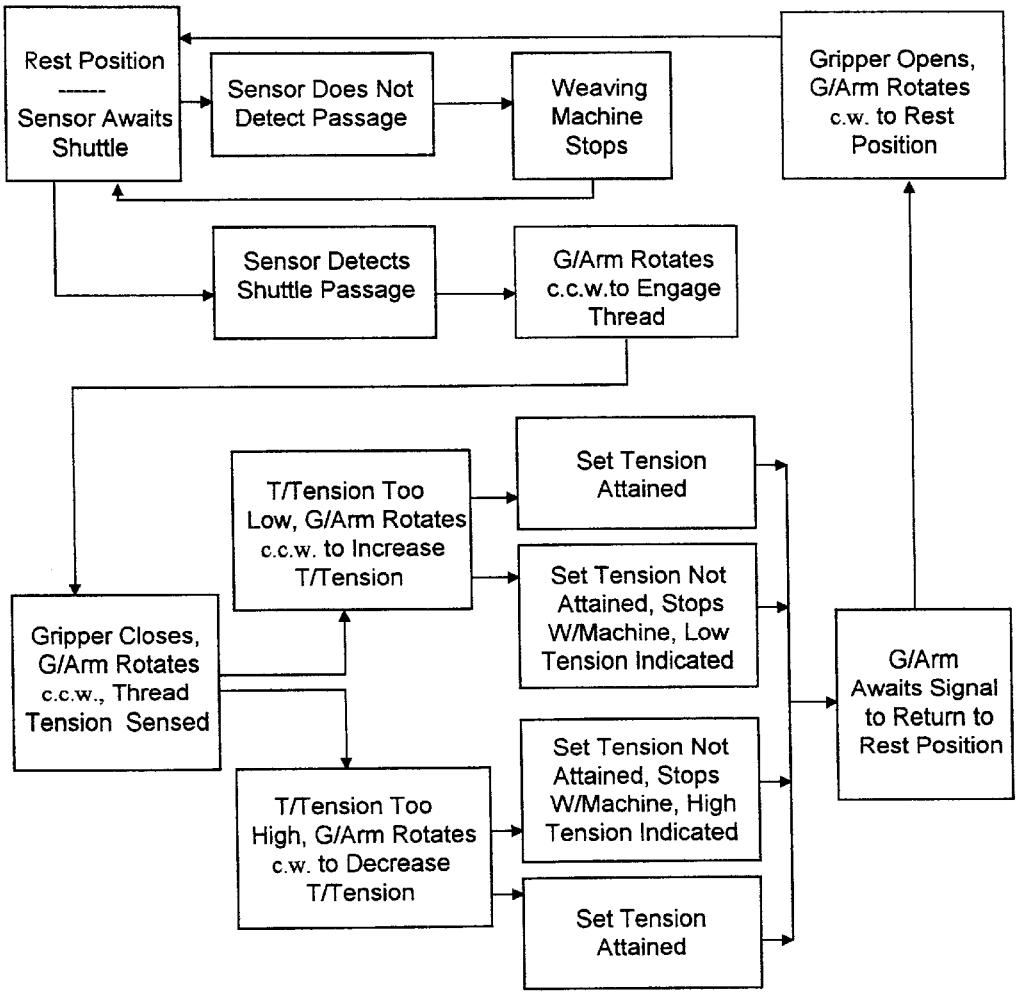
FIG. 7 illustrates a block diagram of the sequence of events of the invention.

FIG. 5 illustrates a thread guide 27. The guide 27 has a radius that guarantees that a thread held in gripper 18 will be in the same position relative to the motor's shaft and therefore guarantees that the thread's stop position will be based on torque sensing. The thread positioning device shown in FIG. 4, has opposed fingers 19 that are driven by air cylinder 20 via arms 21 which are rotatably fixed in the accurate recesses of opposed fingers 19. Extension of the cylinder 20, because the arms 21 are pinned to cylinder 20 by a common pin and to fingers 19 by an individual pin, causes the fingers 19 to move in opposite directions from the vertical to positively position the thread in the same location proximate to gripper 18. Using the positioner 50 is preferred as it is believed to increase the repeatability of thread positioning.

The described thread tensioner apparatus is also able to adjust to the requested thread tension even though the inserted thread tension is higher than the desired tension. When the tensioner registers a tension higher than the desired tension, the respective tensioner, 6 or 7 will then rotate in the reverse direction to thread insertion, to pull thread from the thread supply i.e., shuttle, and reduce the thread tension. As soon as the tensioner detects a tension in the desired range the rotation stops.

With the above operational explanation in mind, the operation of the stepper motor and torque arm can be better understood. The stepper motor is a brushless permanent magnet motor with a full step increment of 1.8 degrees. It is possible to use half or micro steps which yields increments of 0.9 to 0.0144 degrees. Steppermotors may be operated at speed rates up to 20,000 steps per second, and can provide holding torque ratings from 60 to 5330 oz-in (42.4 to 3764 Ncm) with both windings energized. In the present invention the stepper motor operates on phase switched dc power. The motor shaft advances in steps of 1.8 degrees (200 steps per revolution) in the full step mode, and 0.9 degree steps (400 steps per revolution) when in the half step mode. Power transistors connected to flip-flops are used for switching. The motor has a high holding torque, when it is not being stepped, because current is maintained on the motor windings. A suitable stepper motor is available from Superior Electric, Bristol, Conn. as model M063-LS09. The stepper motor may be controlled by a driver, model SS2000MD4-M available from the same manufacturer.

With the above in mind, it can be appreciated that the torque applied or created by the tensioner 6 or 7 can be measured with commercially available strain gauges which will be well known in the art. The strain gauge will detect the initial condition when the thread 4 is engaged by the gripper 18. If the initial tension is too low, the most common condition, the strain gauge will signal the detected tension to the controller which will compare that value to the desired value. Once the condition is determined, the controller will activate the stepper motor in the proper direction to tension the thread. If the tension is too high, the sequence will be the same however, the stepper motor will be activated in the opposite direction.

It will be appreciated that the number of tensioner devices may vary based upon the insertion equipment. Likewise, the gauge of the device will depend on the diameter or denier of the inserted thread.

Figure 8:
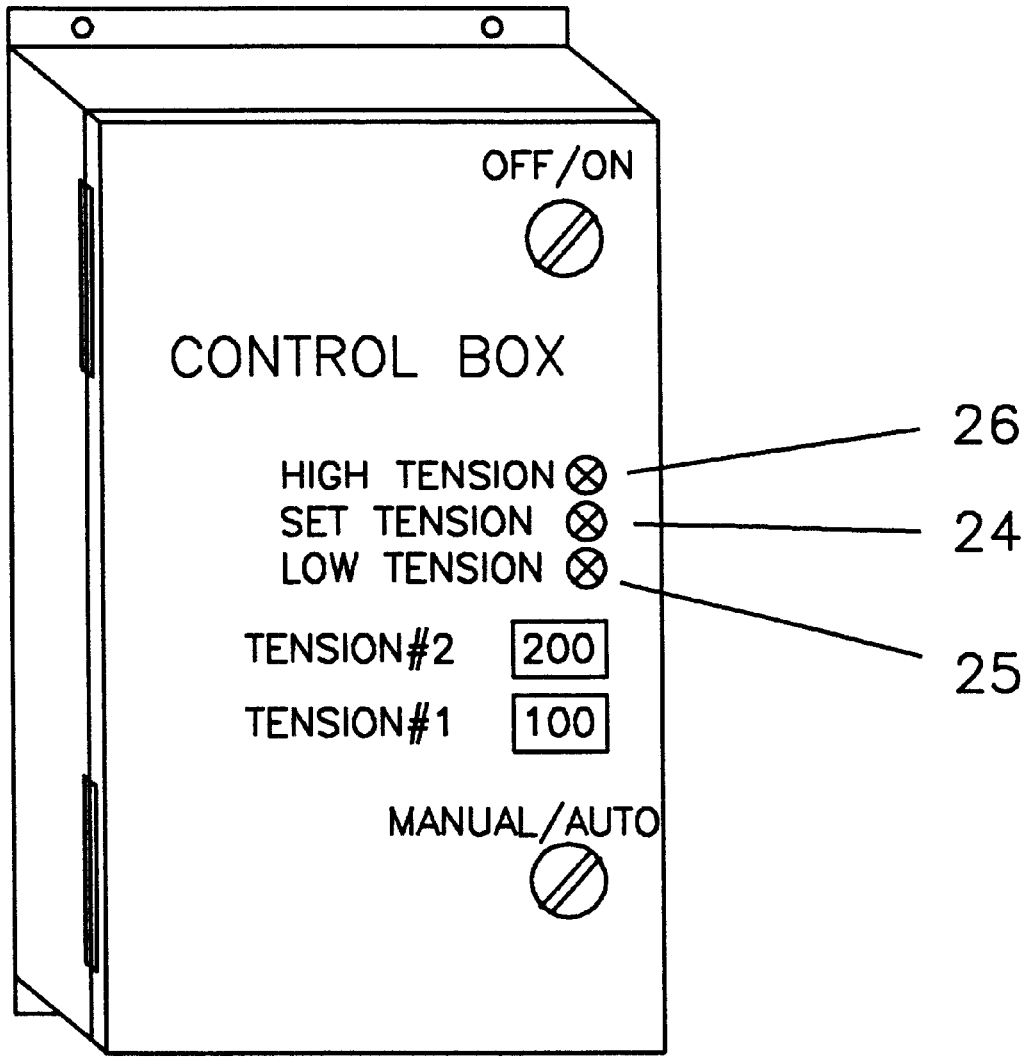
FIG. 8 illustrates a thread tensioner control and display panel.

In FIG. 8 the final tension condition is indicated by 3 LED's (#24) in range, (#25) low range, (#26) high range. By programming the tension range conditions, individual output signals which are dependent upon the controlled thread tension can be displayed. For example, the high and low range output signals can be used to stop the machine and the operator is then able to determine by observing the LEDs the reason the machine has stopped. Instead of LEDs a screen or other components may be used.

We claim:

1. A thread tensioning device which grasps the end of a thread inserted into a weaving shed with a gripper mounted on a torque producing device that holds the gripper in a position where the tension on the inserted thread is substantially equal to a predetermined tension.

2. A thread tensioning device according to claim 1, further comprising a programmable controller which receives the predetermined tension and the thread tension from the torque producing device and compares same.

3. The thread tensioning device of claim 2, wherein the programmable controller provides an output signal that controls the torque producing device.

4. The thread tensioning device of claim 3, wherein the output signal holds the torque producing device in a fixed position when the tension on the thread is substantially equal to the predetermined tension.

5. The thread tensioning device of claim 1 further including a thread positioning apparatus to assure that the thread is held in a desired location relative to the thread's path of travel as it is being inserted, the apparatus comprising:

a body having a central bore;

a drive means mounted on the body and including a piston such that the piston extends along the bore;

opposed links that are rotatably connected to the piston at one end thereof and two pivotal fingers at opposite ends thereof;

each of the pivotal fingers being rotatably connected to the body so that movement of the piston causes the opposed to rotate between separate vertical orientations and crossed acute angles from the vertical.

6. A device for tensioning a thread as it is inserted in an weaving shed for interlacing, the device comprising:

means for detecting an inserted thread in an open shed in a given direction of travel;

means for gripping the inserted thread, said gripping means holding the thread and moving in the direction of travel to apply tension to the inserted thread and holding the thread under tension until it is fully interlaced by a closed shed.

7. The device of claim 6 wherein the gripping means is adapted to hold the thread under a predetermined tension until closing of said shed.

8. The device of claim 7 wherein the gripping means is adapted to hold the thread for a predetermined time.

9. The device of claim 6 wherein the gripping means is adapted to hold the thread for a predetermined time.

10. A device for adjusting the tension on a thread as it is inserted in a weaving shed for interlacing, the device comprising:

means for storing a desired thread tension;

means for gripping an inserted thread;

means for detecting the inserted thread's tension;

means for comparing the detected tension to the desired tension;

means for moving the gripper means along with the inserted thread in a desired direction and;

means for controlling movement of the gripping means to adjust the detected tension toward the desired tension.

11. The device of claim 9 further including a thread positioning apparatus to assure that the thread is held in a desired location relative to the thread's path of travel as it is being inserted, the apparatus comprising:

a body having a central bore;

a drive means mounted on the body and including a piston such that the piston extends along the bore;

opposed links that are rotatably connected to the piston at one end thereof and two pivotal fingers at opposite ends thereof;

each of the pivotal fingers being rotatably connected to the body so that movement of the piston causes the oppose to rotate between separate vertical orientations and crossed acute angles from the vertical.

* * * * *